United States Patent [19]

Bishop

[11] Patent Number: 4,872,228

[45] Date of Patent: Oct. 10, 1989

[54] BED GUARD

[76] Inventor: Carolyn B. Bishop, 1960 Dembrigh La., Charlotte, N.C. 28213

[21] Appl. No.: 212,605

[22] Filed: Jun. 27, 1988

[51] Int. Cl.[4] ..... A47C 21/08

[52] U.S. Cl. ..... 5/425; 5/513

[58] Field of Search ..... 5/425, 427, 436, 437, 5/485, 491, 512, 513

[56] References Cited

U.S. PATENT DOCUMENTS

| | | | |
|---|---|---|---|
| 243,869 | 9/1881 | Doremus | 5/491 |
| 984,324 | 2/1911 | Von Below | 5/513 X |
| 2,644,173 | 7/1953 | James | 5/425 |
| 3,148,387 | 9/1964 | Sarnie, Jr. et al. | 5/431 |
| 3,574,412 | 3/1986 | Smith | 5/436 |
| 3,638,251 | 2/1972 | Weiss | 5/485 |
| 4,173,048 | 11/1979 | Varaney | 5/436 |
| 4,607,402 | 8/1986 | Pollard | 5/425 |

*Primary Examiner*—Michael F. Trettel

*Attorney, Agent, or Firm*—Clifton Ted Hunt

[57] ABSTRACT

A bed guard for temporary use to reduce the risk of falling out of bed comprises at least one elongated bolster operatively assembled on top of a conventional mattress and releasably held in operative position along one side of the bed by a conventional bedsheet covering the mattress and the bolster and tucked under the mattress. A plurality of bolsters may be used on each side of the bed for additional protection.

4 Claims, 2 Drawing Sheets

BED GUARDu

FIELD OF THE INVENTION

This invention relates to bed guards that reduce the risk of people accidentally from falling out of conventional beds without side rails.

BACKGROUND OF THE INVENTION

Some children are moved from a crib with side rails to a regular bed without side rails at an early age. Some young children (and older persons) have a tendency to fall out of bed. The prior art shows that a variety of solutions have been proposed to reduce the risk of persons falling out of bed.

Pat. No. D-148,248 issued Dec. 30, 1947 to Kirkpatrick for CHILD'S BED shows a wooden bed with headboard and footboard and with decorative wooden side rails extending from the headboard and terminating about half way along the length of the bed.

Pat. No. 2,496,068 issued Jan. 31, 1950 to Rutkowski for BED GUARD shows a wooden bed guard removably fastened to a side rail of a conventional bed and extending half the length of the bed.

Pat. No. 4,286,344 issued Sept. 1, 1981 to Ikeda shows a mattress in which integral ridges are formed along the sides of the mattress. The ridges reduce the risk of a person accidentally falling out of bed. In one embodiment of Ikeda, the ridges extend the full length of the bed on both sides. In another embodiment of Ikeda, the ridges extend on both sides only about half the length of the bed.

Pat. No. 4,607,402 issued Aug. 26, 1986 to Pollard shows a retainer sheet comprising a sheet to be spread over a mattress with pockets built into the sides of the sheet to receive and return cylindrical shaped foam retainers intended to reduce the risk of falling out of bed. The foam retainers can be removed when it is desired to wash the sheet.

All of these prior art bed guards are physically attached or formed integral with the bed, mattress, or a special sheet and are consequently expensive. Kirkpatrick and Ikeda both lack the flexibility of removing the bed guard when it is desired to use the bed without them. Rutkowski's bed guard is cumbersome and difficult to store when not is use. Pollard is the most pertinent prior art but requires a special sheet with pockets, which is obviated by the present invention.

SUMMARY OF THE INVENTION

Applicants' bed guard comprises at least one generally cylindrically bolster adapted to be positioned in use on one side of a conventional bed and retained in place by being covered with a conventional sheet which covers the mattress and the bolster(s) and is tucked under the mattress in the usual way.

In the illustrated embodiment of the invention, the bolster(s) is anchored to the mattress by a conventional fitted sheet covering the mattress and the bolster(s) and having pockets at the ends of the sheet to fit over the head and foot of the mattress. It is within the spirit of the invention, however, to anchor the bolster(s) with a conventional rectangular sheet that covers the mattress and is tucked under it in the usual way.

It is an object of the invention to provide a temporary bed guard comprising a generally cylindrical bolster that can be installed in operative position on top of the mattress along one side of the bed while making up the bed, and retained in operative position by a conventional bottom sheet covering the mattress and the bolster(s) and tucked under the mattress.

It is another object of the invention to provide a bolster of the type described which is removable from the bed by simply removing it from underneath the bottom sheet.

It is a further object of the invention to provide a plurality of bolsters of the type described wherein each bolster is less than half the length of the bed and wherein one or more bolsters may be aligned along one or both sides of a conventional bed on top of a conventional mattress and covered with a conventional contour bottom sheet with pockets at its ends to fit around the ends of the mattress and hold the bolster (s) in operative position.

It is another object of the invention to provide bolsters of the type described which are washable.

A further object of the invention is to provide a bolster of the type described which is easily stored when not in use.

It is another object of the invention to provide bolsters of the type described which are retained in operative position by a conventional bottom sheet on a conventional mattress to prevent the accidental falling out of the bed without the need for a special bed, mattress, or sheet.

The present invention eliminates the need for purchasing the special and expensive restraints of the prior art and requires only inexpensive bolsters to be used with a conventional mattress and sheet. The bed may be of any width, from a twin bed to a king sized bed.

DETAILED DESCRIPTION OF THE INVENTION

Figure 3:
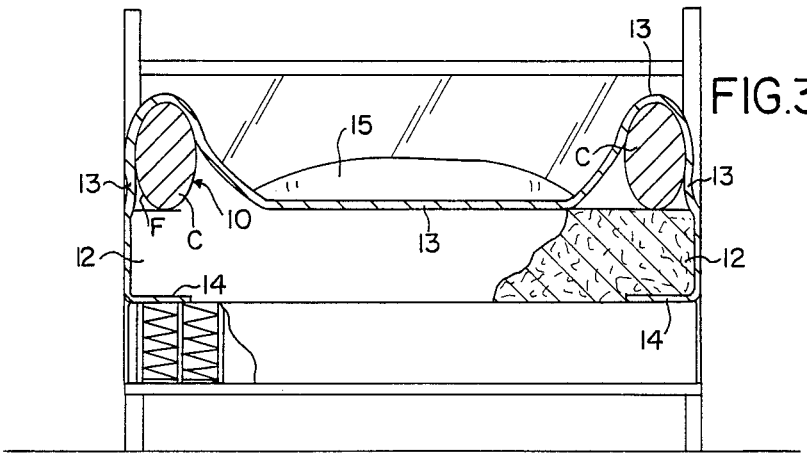
FIG. 3 is a sectional view taken substantially along the line 3—3 in FIG. 2.

Referring more specifically to the drawings, the numeral 10 broadly designates the bolster of this invention. The bolster 10 comprises a core C of a suitable batting, such as polyester fiberfill covered with a soft fabric F, such as cotton. As best seen in FIG. 3, the bolster 10 is of cross-sectional oblong configuration. Cross sectional dimensions of five inches and eight inches have been found to be satisfactory, but the dimensions are not critical to the successful practice of the invention and any desired crosssectional configuration and dimensions may be used.

The bolster 10, as described herein, is made for a twin size bed 11 supporting a mattress 12 measuring 75 inches in length. The bolsters 10 are placed on top of the mattress 12 and extend along the sides of the mattress as shown in the drawings.

The bolster 10 and conventional mattress 12 are covered with a conventional fitted bottom sheet 13 having pockets 14 at each end to fit over the ends of the mattress.

The term "conventional" as used herein with reference to the mattress 12 and bottom sheet 13 means a mattress and sheet with a continuous and uninterrupted planar upper surface, as shown in the drawings.

Figure 1:
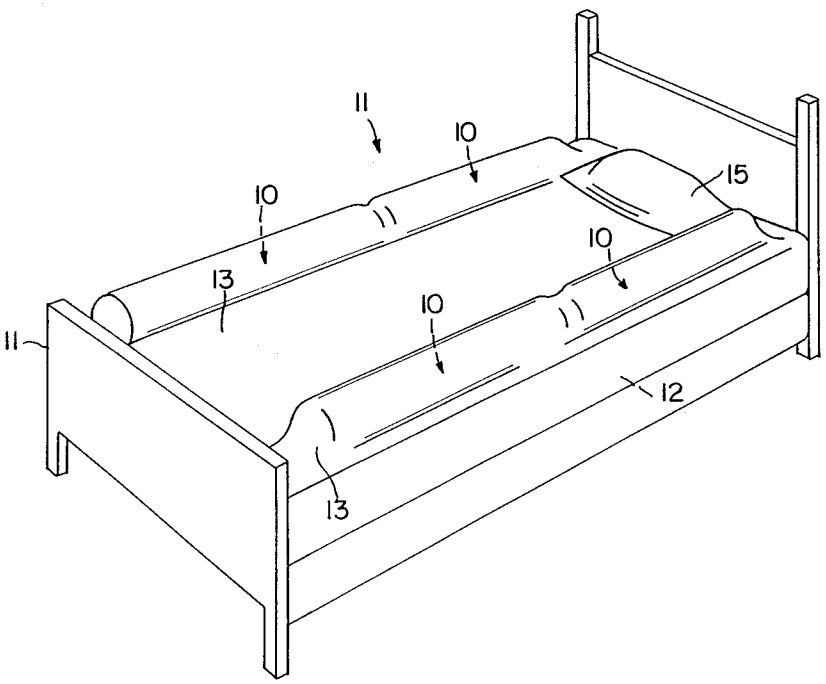
FIG. 1 is a perspective view of a conventional twin bed illustrating the positioning of two bolsters on each side of the bed and illustrating the anchoring of the bolsters in position by a conventional bottom fitted sheet.
Figure 4:
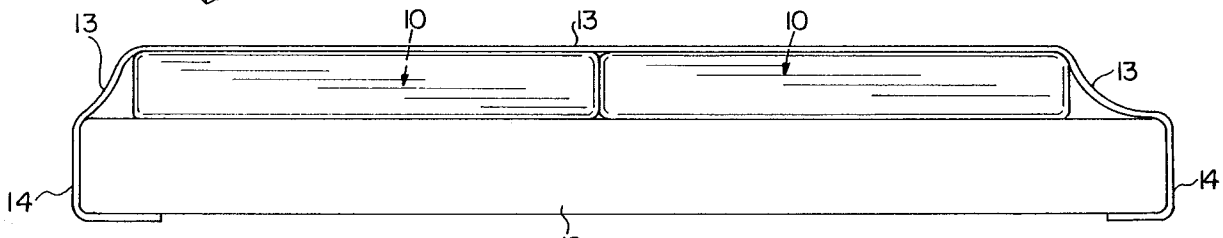
FIG. 4 is a side view looking at the mattress, bedsheet, and bolsters shown in FIG. 1.
Figure 5:
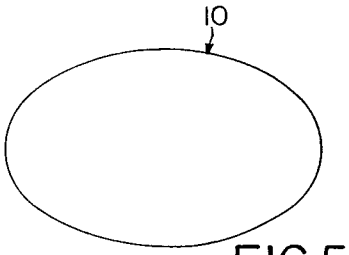
FIG. 5 is an end view of a bolster removed from the bed.

Bolsters for use on mattress 12 each measure 32½ inches long so that two bolsters placed end to end as shown in FIGS. 1 and 4 will be 10 inches shorter than the mattress. These dimensions permit bolsters installed end to end as in FIGS. 1 and 4 to be spaced five inches from the ends of the mattress. This spacing has been found to provide enough slack in the sheet for the pockets in its ends to fit over the ends of the mattress.

The added dimension of the bolsters 10 beneath the sheet 13 tightens the sheet when it is stretched across the bed and anchored beneath the mattress so that tends to extend in spaced parallel relation above the mattress, but is brought into contact with the mattress by the weight of a pillow 15, as seen in FIG. 3.

Figure 2:
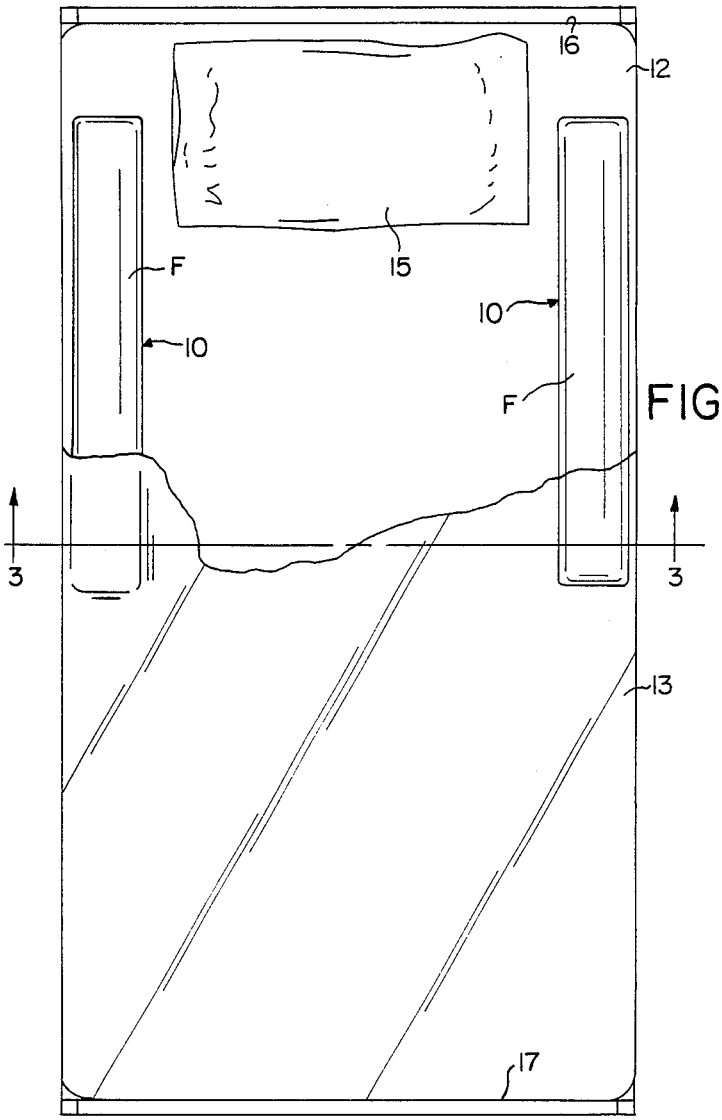
FIG. 2 is a top plan view of a bed with only one bolster on each side of the bed, and with parts broken away for purposes of clarity.

The use of just one bolster on each side of the mattress is illustrated in FIG. 2, wherein the bolsters 10 are spaced about five inches from the head 16 of the mattress and extend about half way toward the foot 17 of the mattress. The length of the bolster is not critical if only one bolster is used on each side of the mattress, provided that, when used with a fitted sheet with pockets at its ends to fit around the ends of a mattress, the overall length is at least 10 inches shorter than the mattress.

It is within the spirit of the invention to use only a single bolster as a bed guard when desired, as when one side of the bed is placed against a wall. The single bolster is covered by a conventional bedsheet to keep it in place in the same manner as described for plural bolsters.

There is thus provided an inexpensive and efficient bed guard which can be readily installed for use with nothing but conventional bed equipment and which may be easily removed for washing or storage when desired.

Although specific terms have been used in describing the invention, they have been used in a generic sense only and not for the purpose of limitation.

I claim:

1. In a bed having a mattress with a continuous and uninterrupted planar upper surface and a bedsheet with a continuous and uninterrupted planar upper surface covering the mattress and tucked under the mattress, the improvement which comprises the combination of means for reducing the risk of a person falling out of bed without interrupting the continuous and uninterrupted planar upper surface of the mattress or the bedsheet, said means comprising at least one separate bolster unconnected to the mattress or the bedsheet and operatively positioned on top of the mattress and extending at least partially along one side of the mattress and under the bedsheet which covers the mattress and is tucked under the mattress, whereby the bolster is frictionally held in operative position between the mattress and the bedsheet.

2. A bed guard according to claim 1 wherein two bolsters are placed end to end on said one side of the mattress.

3. A bed guard according to claim 1 wherein one bolster is placed on each side of the mattress.

4. A bed guard according to claim 1 wherein the bolster is of oblong cross-sectional configuration.

* * * * *